US009718580B2

(12) United States Patent
Moreau et al.

(10) Patent No.: US 9,718,580 B2
(45) Date of Patent: Aug. 1, 2017

(54) TRAY HAVING RAISED EDGES AND ROUNDED CENTERING DEVICES, AND BLANK FOR PRODUCING SUCH A TRAY

(75) Inventors: Jean-Claude Moreau, Saint-brice (FR); Quentin Serre de Lourtioux, Chateaubernard (FR)

(73) Assignee: OTOR, S.A., Paris (FR)

( * ) Notice: Subject to any disclaimer, the term of this patent is extended or adjusted under 35 U.S.C. 154(b) by 147 days.

(21) Appl. No.: 13/882,809

(22) PCT Filed: Nov. 3, 2011

(86) PCT No.: PCT/FR2011/000584

§ 371 (c)(1),
(2), (4) Date: May 7, 2013

(87) PCT Pub. No.: WO2012/059655

PCT Pub. Date: May 10, 2012

(65) Prior Publication Data

US 2013/0213847 A1 Aug. 22, 2013

(30) Foreign Application Priority Data

Nov. 5, 2010 (FR) ..... 10 04355

(51) Int. Cl.
*B65D 21/00* (2006.01)
*B65D 85/62* (2006.01)
(Continued)

(52) U.S. Cl.
CPC ..... *B65D 21/0212* (2013.01); *B65D 5/001* (2013.01); *B65D 5/003* (2013.01); *B65D 5/542* (2013.01); *B65D 5/545* (2013.01)

(58) Field of Classification Search
CPC .... B65D 5/0035; B65D 5/002; B65D 5/0045; B65D 5/443; B65D 21/0235; B65D 5/542;
(Continued)

(56) References Cited

U.S. PATENT DOCUMENTS 2,568,204 A * 9/1951 Recser ..... 229/161
3,034,698 A * 5/1962 Forrer ..... 229/117.04
(Continued)

FOREIGN PATENT DOCUMENTS

DE 102005058289 A1 6/2007
FR 1239460 A1 8/1960
(Continued)

OTHER PUBLICATIONS

International Search Report, in PCT/FR2011/000584 dated Jan. 13, 2012.

*Primary Examiner* — Jacob K Ackun
*Assistant Examiner* — Rafael Ortiz
(74) *Attorney, Agent, or Firm* — Banner & Witcoff, Ltd.

(57) ABSTRACT

The present invention relates to a tray made of corrugated cardboard sheet material, and to blanks for preparing such a tray having a polygonal cross-section. Said blank comprises sidewalls, raised edges or portions of raised edges on two opposite sides of an upper portion, and a lower wall forming the bottom (36) of the case. Each raised edge or portion of raised edge includes at least one rounded portion (34), and the bottom includes perforated surface portions (35) which have a shape complementary to that of the rounded portions, which are arranged opposite the latter, and are arranged so as to fit into the rounded portions of the tray from below.

16 Claims, 5 Drawing Sheets

(51) Int. Cl.

| | |
|---|---|
| ***B65D 21/02*** | (2006.01) |
| ***B65D 5/00*** | (2006.01) |
| ***B65D 5/54*** | (2006.01) |

(58) Field of Classification Search

CPC .... B65D 5/545; B65D 21/0213; B65D 5/001; B65D 5/003; B65D 21/00; B65D 85/62

USPC ..... 206/499, 509, 511, 512, 518, 784; 229/122, 915, 918, 919, 200, 925, 240

See application file for complete search history.

(56) References Cited

U.S. PATENT DOCUMENTS

| | | | | |
|---|---|---|---|---|
| 3,114,495 | A * | 12/1963 | Grooms | 206/519 |
| 4,053,098 | A * | 10/1977 | Baptist | 206/509 |
| 6,712,214 | B1 * | 3/2004 | Wintermute et al. | 206/745 |
| 6,935,504 | B2 * | 8/2005 | Ritter et al. | 206/511 |
| 7,784,676 | B2 * | 8/2010 | Borek | B65D 5/542 229/117.16 |
| 2003/0213835 | A1 * | 11/2003 | Riedi | 229/122 |
| 2015/0083788 | A1 * | 3/2015 | Moreau | B65D 5/427 229/5.5 |

FOREIGN PATENT DOCUMENTS

| | | | |
|---|---|---|---|
| FR | 2728867 | A1 | 7/1996 |
| FR | 2905937 | A1 | 3/2008 |

* cited by examiner

TRAY HAVING RAISED EDGES AND ROUNDED CENTERING DEVICES, AND BLANK FOR PRODUCING SUCH A TRAY

The present invention relates to a tray made of corrugated sheet cardboard material with a polygonal cross-section, comprising lateral walls, raised edges or portions of raised edges on two opposite sides in its upper part, and a lower wall which forms the base of the tray.

It also relates to blanks for constitution of a tray of this type.

It has a particularly important, but not exclusive, application in the field of trays which are stackable on a pallet, and can tend to slide relative to one another when they are being handled during the transport phases.

Centering systems for trays are already known which make it possible to prevent sliding of the trays, by means of lateral tenons which co-operate with orifices placed in the ridges, or in the vicinity of the latter.

Systems of this type are fragile, and do not withstand repeated handling operations.

Packaging is also known (FR 2 311 717), the lid of which is formed by flaps, some of which have a form complementary to those of cut-outs provided in the base which is also formed by flaps, thus making possible fitting and therefore lateral blocking.

Apart from the fact that this embodiment makes it necessary to have a lid on the tray, it is not suitable for low basis weights, and does not always permit perfectly vertical stacking, as a result of the offsettings which can exist when the case is being formed.

The object of the present invention is to provide a tray made of corrugated sheet cardboard, which complies better than those previously known with the requirements in practice, in particular because, firstly, it proposes centering of the trays on one another, thus permitting sliding and lateral putting into place before fitting and blocking, without any risk of damaging the centering means which will be used, and secondly because it permits formation of the trays which is simple and inexpensive.

By means of the invention it will therefore be possible to avoid any sliding of the trays when they are stacked on one another whilst they are being palletized, and thus to permit the use of a light basis weight, at the same time avoiding the use of palletization accessories which are costly and give rise to additional handling.

For this purpose, the present invention proposes in particular a tray made of corrugated sheet cardboard material with a polygonal cross-section, comprising lateral walls, raised edges or portions of raised edges on two opposite sides in its upper part, and a lower wall which forms the base of the case, characterized in that each raised edge or portion of raised edge comprises at least one bulged portion, and in that the base comprises portions of perforated surface with a form complementary to said bulged portions, which are in an aligned manner a top the latter and are designed to be fitted in the bulged portions of the tray below.

A portion of perforated surface with a complementary form means a flat recess with dimensions such that the part with the bulged portion which is inserted in it abuts at least part of the periphery of the recess, which makes it possible to block the longitudinal and transverse movements on the horizontal plane of one tray relative to the other.

In advantageous embodiments, in addition, recourse is made to one and/or the other of the following arrangements:

Each raised edge or portion of raised edge is rendered integral with the top of the adjacent lateral wall via a joining line which is not straight, and/or is not aligned continuously, in order to form said bulged portion which projects relative to the top surface of the tray, when the tray is being formed.

Not aligned continuously means a joining line comprising a first portion which is parallel to, and situated at a first distance d from the base of the tray, and a second portion which is situated at a second distance d+e from said base.

The non-straight joining line and/or the non-aligned part situated at the distance d+e extend towards the exterior in an aligned manner a top, or substantially in an aligned manner a top, to the part which is designed to be bulged.

Advantageously, e is contained between ⅓ and ¾ of the thickness of the corrugated cardboard, for example it is equal to half said thickness.

The lower wall and the lateral walls are formed by a trough;

The tray comprises at least two corner portions of raised edges which are symmetrical relative to the center of the tray, said portions being connected on one side to tongues for securing on the adjacent lateral wall opposite, and having on the other side an end part forming a surface which is deformed towards the exterior of the top of said tray thus constituting said bulged portion.

The dimensional characteristic on the non-straight or non-aligned joining lines thus gives rise to twisting and/or bulging of said part, when the raised edge or the portion of raised edge is bent and secured rigidly by gluing at its end(s) on the corner of the tray;

The tray comprises two sets of two corner portions which are symmetrical relative to the transverse axis of the tray;

The end part is in the form of a rounded ear which is twisted towards the exterior;

Each raised edge is formed by a flap with a projecting central part which constitutes said bulged portion, and two end parts which are connected to tongues for securing on the adjacent lateral wall opposite;

The lines for joining of the raised edges or portions of raised edge with the lateral walls are in the form of a compressed Ω, the top of which faces towards the exterior of the tray;

At least two lateral ends of projecting bulged portion which are situated respectively towards the lateral walls adjacent to the wall of the raised edge or portions of raised edges on the same side of the tray, are extended by a line which can be cut in the wall of the raised edge or portions of raised edge, said line which can be cut opposite aslant towards the line for joining with the base, as far as the outer end of the portions of perforated surface.

An arrangement of this type will allow a panel of wall to be torn in order to permit facilitated access to the products, and/or their presentation, by using the tray thus perforated as a display unit.

The invention also proposes a blank which makes it possible to obtain a tray of this type.

Also, and in particular, it proposes a blank made of corrugated sheet cardboard material, designed to form a tray with a polygonal cross-section comprising lateral surfaces, opposite raised edges or portions of raised edges on two opposite sides in its upper part, and a lower surface or flaps which form the base of the tray, characterized in that each raised edge or portion of raised edge is formed by a flap which is rendered integral with the top of the adjacent lateral wall, via a joining line which is not straight and/or is not aligned continuously, in order to form a bulged portion which projects relative to the top surface of the tray when said tray is being formed, and in that the base comprises portions of perforated surface with a form complementary to said bulged portions.

Advantageously, the blank comprises a lower surface which forms the base, and at least two corner portions of raised edge which are symmetrical relative to the center of the blank, said portions being connected on one side to securing tongues, and having on the other side an end part which can form a surface which is deformed towards the exterior of said tray, in order to constitute the bulged parts when the tray is being formed.

Advantageously, the blank also comprises two sets of two corner portions which are symmetrical relative to the transverse axis of the tray.

According to an advantageous embodiment, the blank comprises lower flaps which are situated on one side of the lateral surfaces, in order to form the base of the tray, and at least two corner portions of raised edges which are situated on the other side of the walls, said portions having an end part which can form a surface which is deformed towards the exterior of said tray, in order to constitute the bulged parts when the tray is being formed.

According to another advantageous embodiment, the end portions are in the form of a rounded ear.

Advantageously, each raised part is formed by a flap with a central part which can project in order to constitute said bulged portion when the tray is being formed, and two end parts connected to tongues for securing on the adjacent lateral wall opposite.

Also advantageously, the lines of joining of the raised edges or portions of raised edge with the lateral walls are in the form of a compressed Ω, the top of which faces towards the exterior of the blank.

According to another advantageous embodiment, at least two lateral ends of projecting bulged portion, which are situated respectively towards the lateral walls adjacent to the wall of the raised edge or portions of raised edges on the same side of the tray, are extended by a line which can be cut in the wall of the raised edge, said line which can be cut opposite aslant towards the line for joining with the base, as far as the outer end of the portions of perforated surface.

The invention will be better understood by reading the following description of embodiments provided hereinafter by way of non-limiting examples. The description refers to the accompanying drawings, in which:

Hereinafter in the description, as far as possible the same reference numbers will be used to designate the same elements or similar elements.

FIG. 1 shows a blank 1 made of corrugated sheet cardboard material, which for example is 3 mm thick, and is designed to form a tray with a rectangular cross-section.

Figure 1:
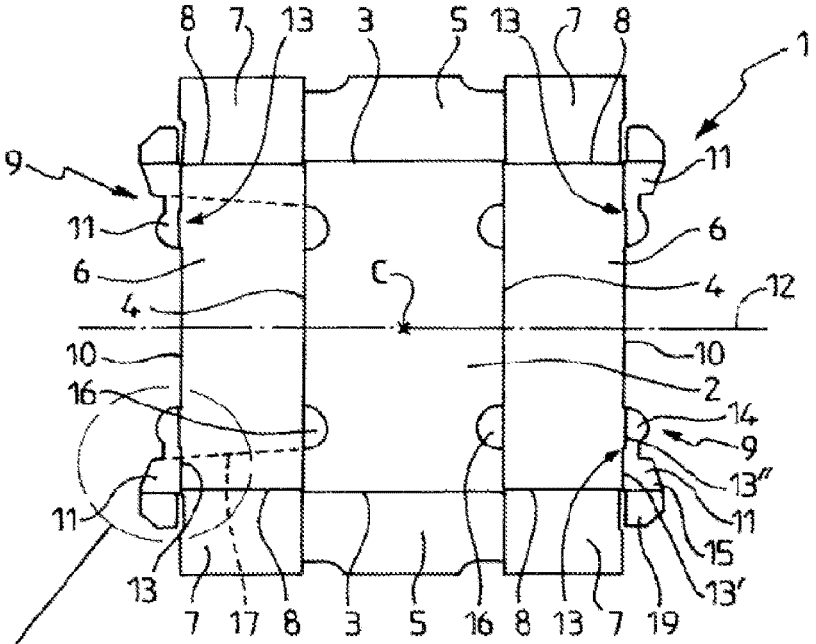
FIG. 1 is a plan view from above of a blank according to a first embodiment of the invention.

The blank comprises a base wall 2 which is connected on these sides by bending lines 3, 4 to lateral walls or surfaces, i.e. two opposite identical rectangular transverse lateral surfaces 5 and two opposite identical longitudinal lateral surfaces 6.

The lateral surfaces 6 are also rectangular and comprise on both sides end flaps 7 which are connected to said surfaces 6 by bending lines 8 in a manner which in itself is known, in order to form a tray.

Each of the longitudinal lateral surfaces 6 also comprises two portions of raised edges 9.

More specifically they comprise on their longitudinal edges 10 opposite the bending lines 4 two tongues 11 in the form of ears which are symmetrical relative to a longitudinal axis of the blank 12.

These tongues are integral with the edge 10 which also constitutes the top of the longitudinal lateral wall 6 when the packaging or tray is formed, via a joining line 13 which is not straight.

More specifically, the line 13 comprises a first part 13' which is situated in the extension of, and is aligned with the end edge 10 situated between the two portions of raised edge, and a second part 13" which is offset from the first part towards the exterior of the line, relative to the upper edge 10. This second part is thus misaligned relative to the line 13' and to the upper edge 10 towards the exterior of the blank, by a distance e which for example is equal to 1.5 mm, and is opposite an interior part 14 of the portion of raised edge formed by the ear 11. As seen in FIG. 1A, a portion of the joining line 13 that includes second part 13" and a portion of first part 13' is limited to a region R1 between the tongue 11 and the top of adjacent lateral wall 6.

The ear 11 thus comprises the inner part 14, which for example is rounded in the form of a half circle. In addition, towards the exterior and in the direction of the joining with the bending line 8, it comprises a part 15, opposite the portion 13", which itself ends in a tongue 19 for securing of the outer edge of the ear on the outer surface of the flap 7 or tab 5 after formation of the tray.

The offsetting of the bending line 13" opposite the part 14 which protrudes relative to the bending line 13' opposite the part 15, will give rise to cambering when the packaging or tray is formed, thus providing this part 14 with a form which projects relative to the top surface of the tray, as will also be described hereinafter with reference to FIGS. 3 and 4.

In an aligned manner a top, and opposite these interior parts 14 which are designed to protrude, on the base 2 there are recesses or portions of recessed surface 16 with a complementary form, which have a bulged part towards the interior of the blank, and the diameter of which coincides with the bending line 4.

The base 2 of the tray thus comprises four semicircular recesses 16 which are designed to co-operate with bulged parts of another tray when the tray is being formed.

In this embodiment described with reference to FIG. 1, pre-cut lines 17 are provided between the intermediate part situated between the parts 14 and 15 of the ears, and the lateral end which faces towards the flap 5 of the recess 16.

Figure 5:
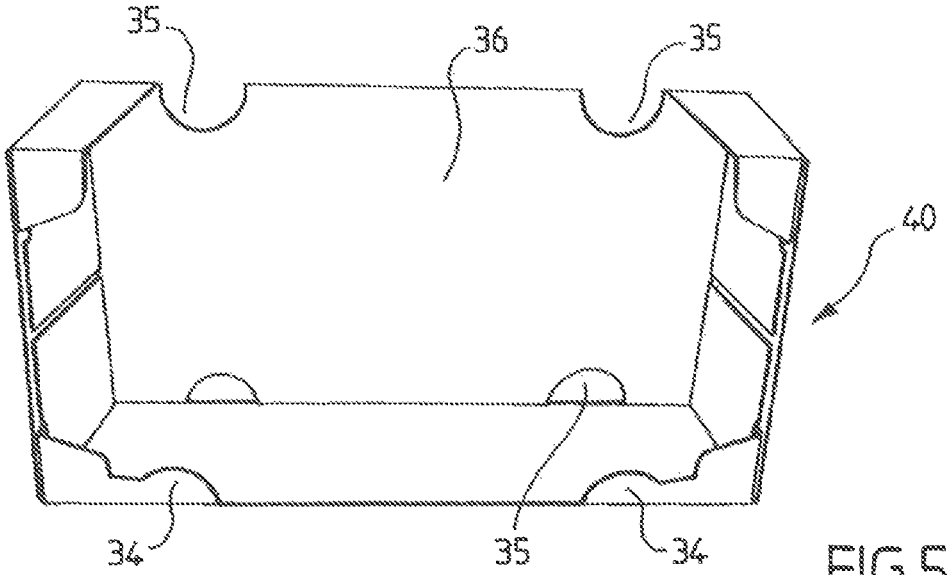
FIG. 5 is a view in perspective of a tray in FIG. 3 or FIG. 4 after tearing of a lateral wall, thus making it possible to release an opening for presentation of the products.

These pre-cut lines, which are in broken lines in the figure, will permit tearing of the surface, which will thus allow easier access to the products, as shown with reference to FIG. 5.

FIG. 1A shows an enlarged view of the ear 11, which shows better the offsetting between bending lines 13' and 13". The bending line 18 of the flap 7 with the wall 6 is also slightly offset towards the interior by a thickness h which is for example substantially that of the cardboard, in order to permit good bending.

The ear 11 additionally comprises a flap or tongue 19, which for example is rectangular or trapezoidal, and can be bent and glued on the outer surface of the transverse wall of the tray.

Figure 2:
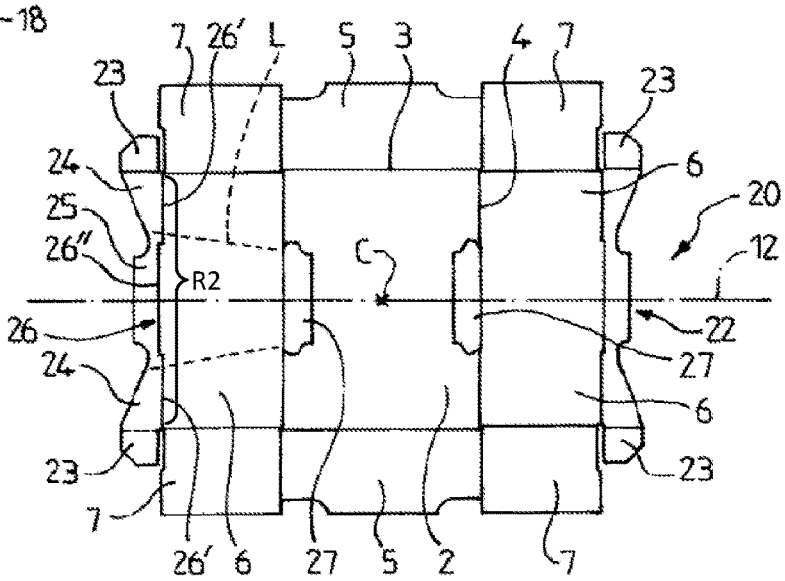
FIG. 2 is a plan view from above of a blank according to a second embodiment of the invention.

FIG. 2 shows another embodiment of a blank 20 of a tray 21 according to the invention.

Figure 1A:
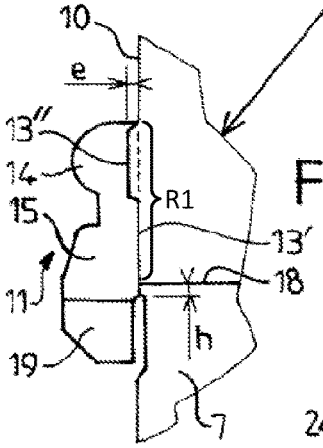
FIG. 1A is a detail of FIG. 1.

Similarly to the blank in FIG. 1, the tray comprises a base 2 provided with lateral walls which are connected by bending lines 3, 4 to transverse 5 and longitudinal 6 lateral walls, in a manner which in itself is known.

Each longitudinal wall 6 comprises lateral flaps 7 which make it possible to form the tray, this time according to the embodiments illustrated with reference to FIGS. 6 and 7.

Each of the surfaces 6 in this case comprises raised edges 22 comprising on both sides tongues 23 for securing on the outer lateral surfaces of the flaps 7 and/or of the wall 5.

In this embodiment, each of the raised edges 22 comprises end parts 24 which are substantially triangular or trapezoidal, the outer edge of which, which forms the hypotenuse or a side of the trapezium, is aslant towards the base of the tray, and symmetrical relative to the transverse axis 12.

The parts 24 are connected to a substantially rectangular central part 25, which protrudes towards the exterior relative to the ends of the aslant sides of the parts 24.

The part 25 is attached to the outer periphery of the lateral wall 6 by a bending line 26 which is misaligned, i.e. which comprises two parts 26' opposite aligned ends 24, and a part 26" which is misaligned towards the exterior relative to the lines 26' opposite the portion 25. As seen in FIG. 2, a portion of the bending line 26 limited to a region R2 between the edge extension 22 and the top of an adjacent one of the lateral walls 6 includes the part 26" and portions of both parts 26'.

This misalignment is for example a thickness e corresponding to a half thickness of the cardboard, but can for example be contained between a third of the thickness and the thickness of the cardboard, for example it can be two thirds of the thickness.

Opposite and in an aligned manner a top the portion 25, which during the bending will be able to project relative to the upper surface of the tray, in order to constitute the bulged part, in the base 2 of the tray there are recesses 27 with a complementary form, in this case thus substantially rectangular, which will allow one tray to be snapped into another in order to form the centering, as claimed.

These parts 25 which project from one of the surfaces can for example be connected to the recess 27 opposite at the base of the tray by pre-cut lines L which allow the upper surface to be torn for presentation of the products.

In another formulation, it can be said that the lines of joining of the raised edges or portions of raised edges to the lateral walls are in the form of a compressed Ω (omega), the top of which faces towards the exterior of the blank.

Figure 3:
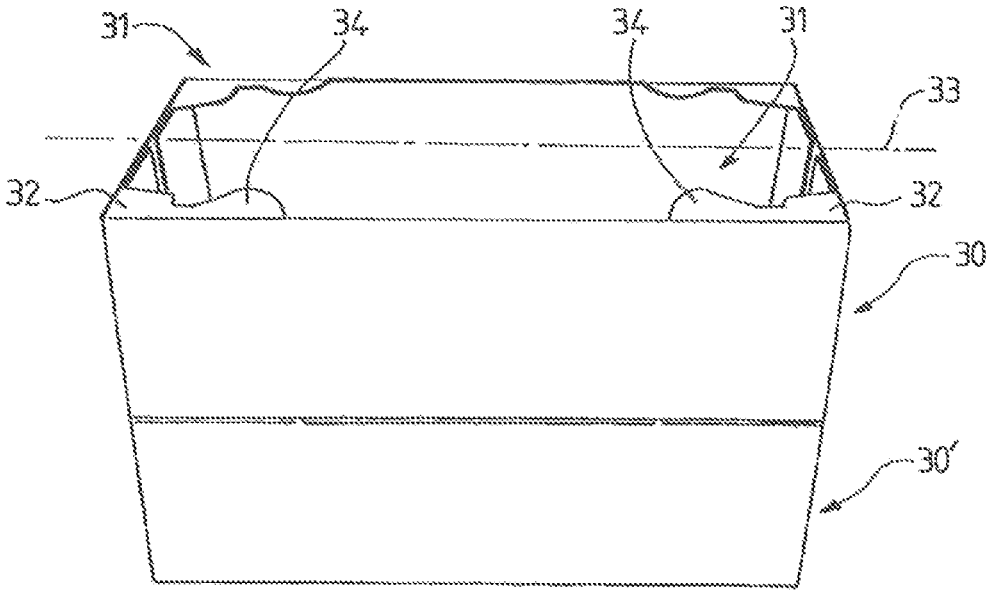
FIG. 3 is a view in perspective showing the nesting of two trays obtained from the blank in FIG. 1.
Figure 4:
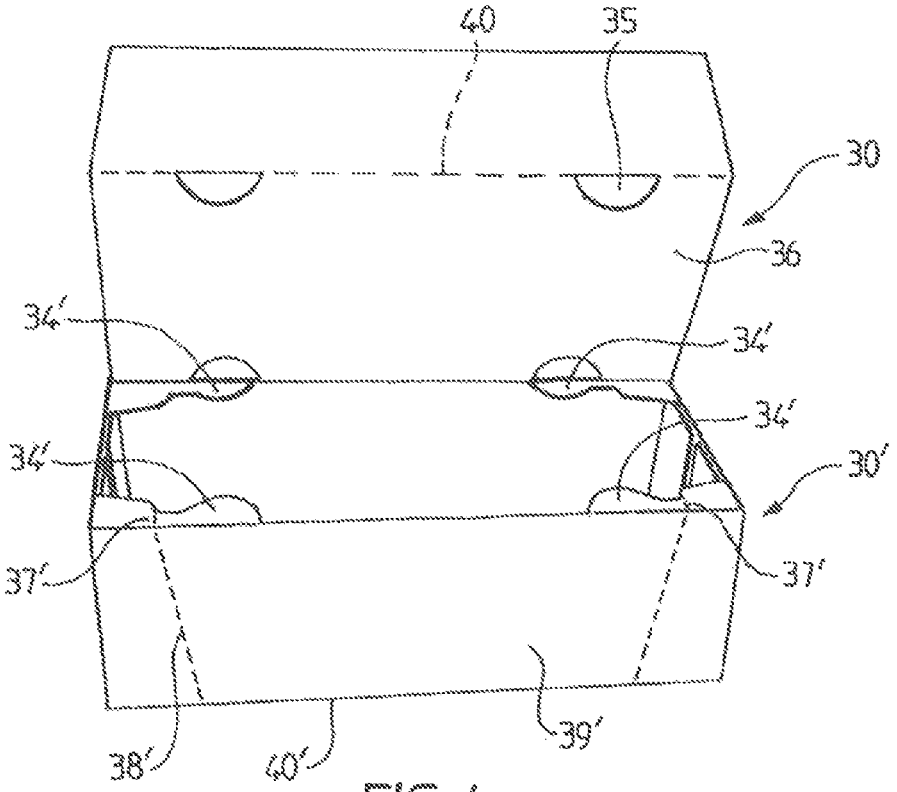
FIG. 4 is a view in perspective of the two trays in FIG. 3, in a partially spaced position making it possible to illustrate better the nesting function of the centering parts according to an embodiment of the invention.

FIGS. 3 and 4 show stacks of trays produced from the blank in FIG. 1.

FIG. 3 thus shows a tray 30 provided with two sets 31 of portions of raised edge.

Each set of portions of raised edge comprises two portions 32 at the corner of the tray, and is symmetrical with the other set, relative to the transverse axis 33 of the tray, said portions having an end part 34 which forms a surface which is deformed towards the exterior above the tray, thus constituting said bulged portion.

FIG. 4 shows the recesses 35 in the form of a half circle, corresponding to the recesses 16 in the blank 1.

FIG. 4 also shows the lines 38' which can be cut of the tray below 30', corresponding to the lines 17 of the tray 1.

More specifically, each outer lateral end 37' of projecting portion 34' is extended by a line 38' which can be cut in the adjacent wall 39', opposite aslant towards the line 40' of joining with the base, as far as the outer end, i.e. towards the transverse walls, of the portions of perforated surface 35' (corresponding to the surfaces 35 of the tray above).

This allows this wall 39' to be torn, in order to obtain the open packaging 40 as represented in FIG. 5.

Figure 6:
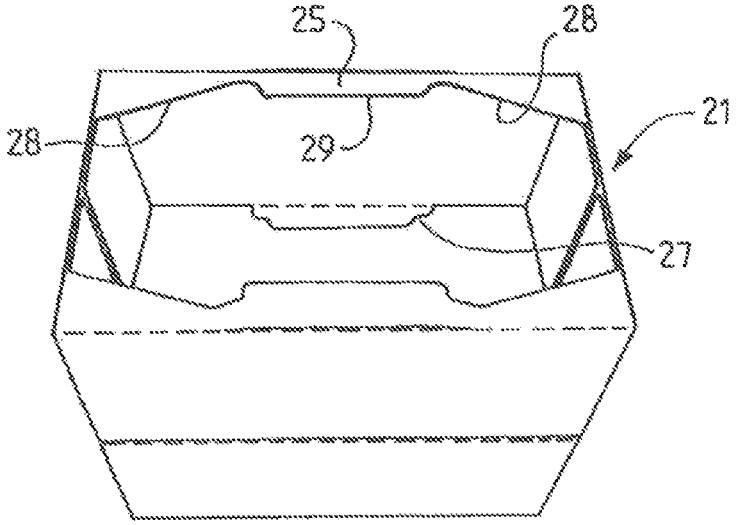
FIG. 6 is a view in perspective from above showing the nesting of two trays obtained from the blanks in FIG. 2.

FIG. 6 shows the tray obtained with the blank in FIG. 2.

The nesting of the bulged part is in this case constituted by the part 25, which fits in the orifice or recess 27 situated in the base, the raised edge itself having the form of a Q which faces towards the interior of the tray, with lateral branches 28 aslant towards the top of the Q, with the central bar 29 forming the end edge of the projecting part.

Advantageously, the lateral edges 30 of this substantially rectangular projecting part are rounded at the level of joining with the lateral branches.

The bulged part snaps into the recess 27, itself having a form which delimits a Q, the vertical branches of which, widened slightly towards the exterior, are blocked against the lateral edges 29'.

The central bar 29 for its part abuts or slightly overlaps internally or externally the edge 27' of the recess 27 parallel to the bending line 27" of the base of the tray.

Figure 7:
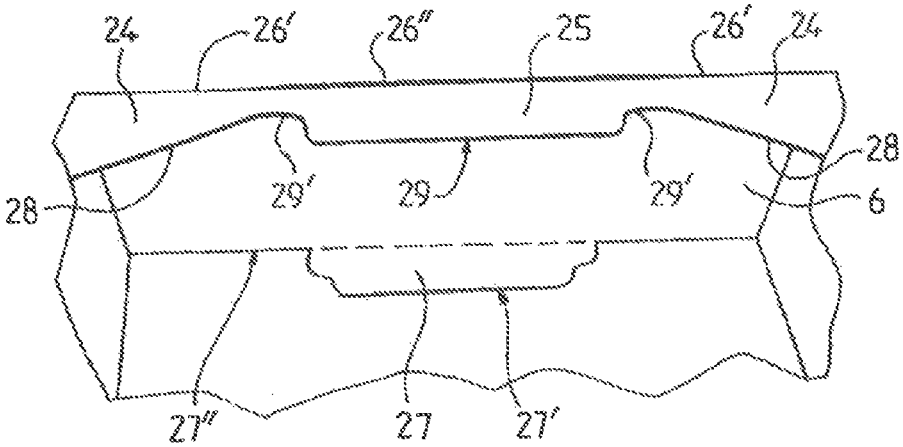
FIG. 7 is an enlarged view showing more particularly the nesting parts which permit the self-centering.

More specifically, FIG. 7 shows an enlarged exploded view which makes it possible to see better the part 25 which is bulged relative to the adjacent parts 24, as a result of the offsetting of the bending lines for joining with the surface 26, 26' and 26".

Figure 9A:
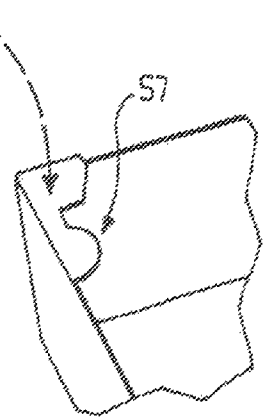
FIG. 9A is an enlarged view from above of a raised edge of the blank in FIG. 8, which can snap into a recess in the base in FIG. 9.
Figure 9:
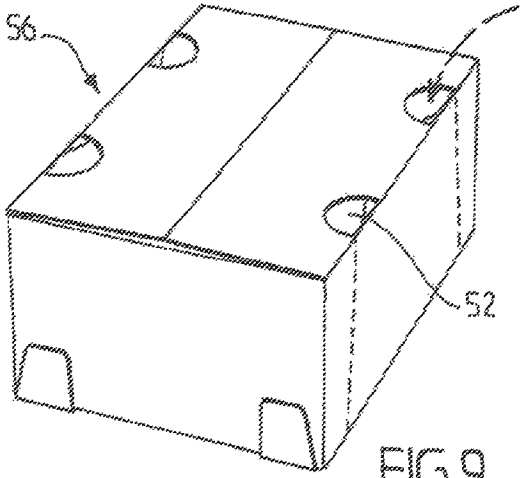
FIG. 9 is a view in perspective showing the base of the tray obtained with the blank in FIG. 8.

FIG. 9 shows a blank 41 formed by an enclosure of four rectangular walls 42, 43, 44, 45 which are connected to one another by parallel bending lines 46, and end in a gluing tongue 47.

The enclosure comprises on one side four flaps 48, 49 which are identical in pairs, and are designed to form the base of the tray, connected to the adjacent walls by bending lines 50, 51, and comprising, for two flaps 48 connected to two walls 42, 44 designed to form two opposite lateral surfaces of the tray, recesses 52 which are similar or identical to the recesses 16 or 35 described with reference to FIG. 1 or 4.

On the other side of the flaps of the base, the walls 42, 44 comprise portions of raised edges 53 which have bulged parts 54 and misaligned bending lines 55, for joining between portions of raised edges and walls, in a manner identical to the portions of raised edges 9 or 32.

In a manner which is identical to the flaps 19, end flaps 53' are provided which can be folded back and glued on the side in order to create the cambering.

Figure 10:
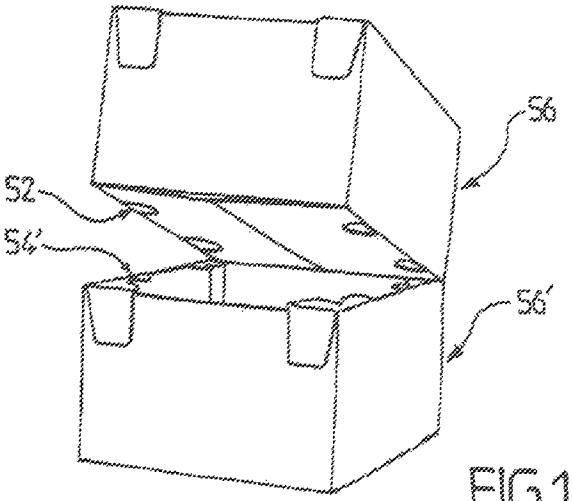
FIG. 10 is a view in perspective of two trays in FIG. 9, showing their nesting.

FIG. 9 shows an overturned tray 56, the recesses 52 of which are designed to co-operate with the bulged part 57 of the top of the tray (cf FIG. 9A), such that the case below 56' co-operates with the case above 56 by fitting into the recesses 52 by means of the bulged parts 54' (cf FIG. 10).

Figure 11:
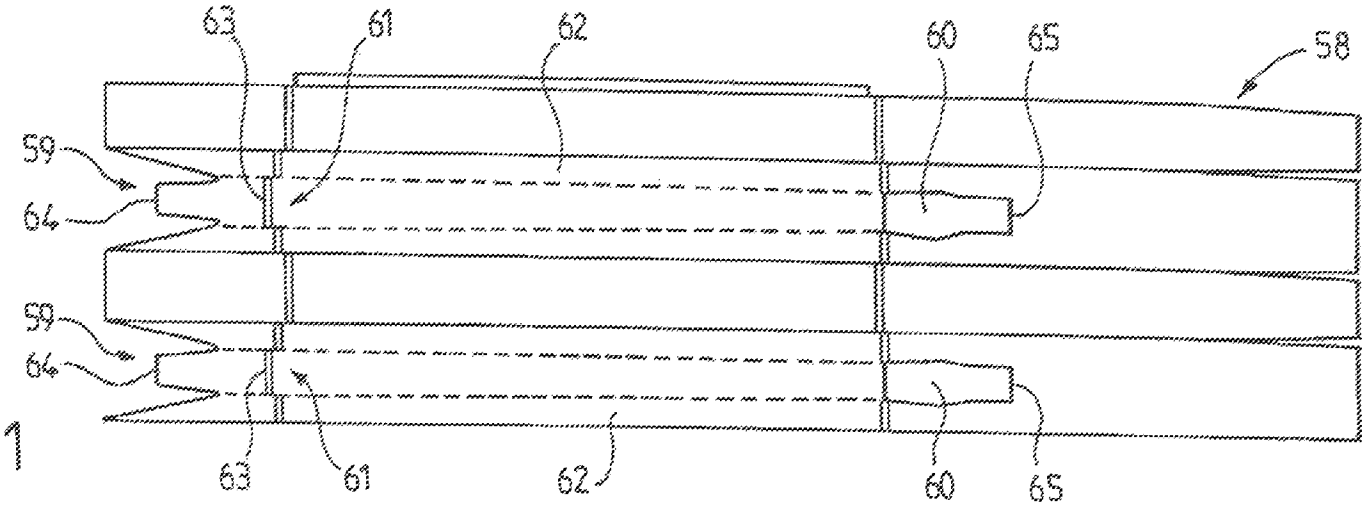
FIGS. 11 and 12 are plan views of two other embodiments of blanks according to the invention.

FIG. 11 is a view from above of a blank 58 according to one embodiment of raised edges 59 corresponding to the raised edges 22 in FIG. 2, and of a recess 60 corresponding to the recesses 27. The bending lines 61, which are represented by parallel lines in FIGS. 11 and 12, are in the form of a Q between rectangular walls 62 and the raised edges, the central bar 63 of the Q opposite a portion 64 in the form of a tongue of the raised edge, in order to snap into the recess 60, whilst slightly overlapping with the end 65 of said recess.

Figure 8:
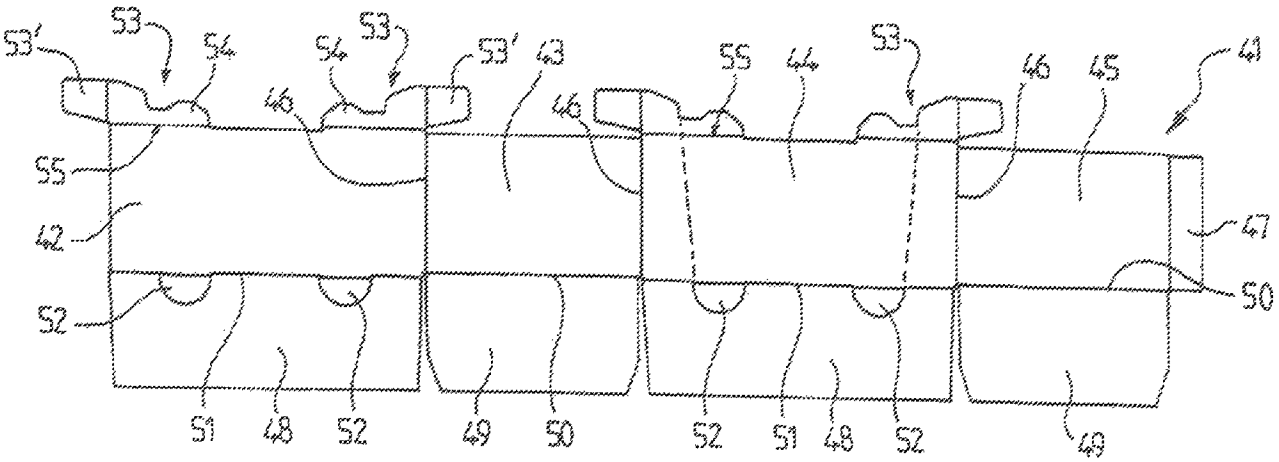
FIG. 8 is a plan view from above of a blank according to another embodiment of the invention.
Figure 12:
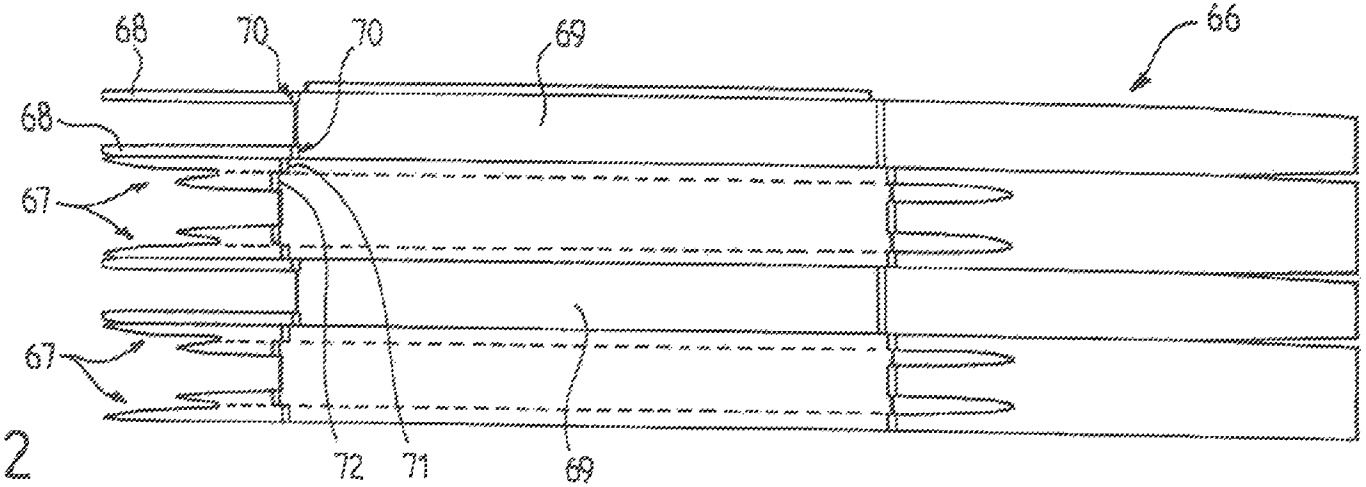

FIG. 12 shows another embodiment of a blank 66 of the type such as the blank 41 described with reference to FIG. 8.

In this case, the portions 67 of raised edges do not have an end tongue, but will be glued firstly onto two narrow flaps 68 situated on both sides of the tab or panel 69 (without the portions of flap) and attached to said tab by bending lines 70 which are offset towards the center of the blank by a thickness e' relative to the lower branch 71 of the misaligned bending line 72, as for the line 55, where e'=½ the thickness of the cardboard for example.

A description will now be provided of the method for formation of a tray according to the invention, with reference to FIGS. 1,3 and 4.

Starting with the blank 1 in FIG. 1, the tray is formed by bending back the lateral surfaces.

For this purpose, bending is carried out for example automatically around a mandrel and/or in a manner which in itself is known, of the longitudinal lateral surfaces 6 then the flaps 7 of these previously glued lateral surfaces, on the exterior of which there is then applied the transverse wall 5, which in this case is also secured by gluing.

Then, the tongues 19 are folded back and secured on the outer surface of the wall 5.

By this means, the portions of raised edge are brought towards the upper surface of the tray.

At the moment of formation, the offsetting of the bending lines then gives rise, structurally, to an effect of cambering on the end parts 14, 34 of the portions 11.

This cambering effect, which thus provides a protuberance relative to the surface of the upper face of the tray, will make it possible to create a centering element which is designed to be fitted in the perforated surfaces or recesses 16, 35 in the base of the tray above.

Fitting of this type therefore provides excellent stability between the trays, and in a simple manner.

As will be appreciated, and is also apparent from the foregoing description, the present invention is not limited to the embodiments described more particularly.

On the contrary, it incorporates all the variants, and in particular those in which the form of the bulged portions is different, those in which the end flaps or tongues 19, 23 are trapezoidal or rectangular, and are glued on the adjacent flap 7 or on the lateral surface 5, on the exterior or fitted between one another.

The invention claimed is:

1. A tray made of corrugated sheet cardboard material with a polygonal cross-section, comprising:

lateral walls;

edge extensions on two opposite sides at upper outer edges; and at least one lower wall which forms a base of the tray, wherein each edge extension has only one protruding bulged portion, the base comprises portions of perforated surface with forms complementary to said bulged portions, the portions of perforated surface are aligned with the bulged portions and are designed to be fitted on bulged portions of a like tray positioned below the tray, each edge extension is integral with a top of an adjacent one of the lateral walls via a corresponding continuous joining line which, in a portion of the joining line limited to a region between the edge extension and the top of that adjacent one of the lateral walls, is either (i) not straight or (ii) has a first part not aligned continuously with a second part, and each of the joining lines projects the bulged portion of the corresponding edge extension upward relative to surrounding regions of a top surface of the tray.

2. The tray as claimed in claim 1, wherein the lower wall and the lateral walls are formed by a rectangular bottom panel with its four sides connected to the lateral walls, forming a trough.

3. The tray as claimed in claim 1, wherein it comprises at least two edge extensions at the corners of the tray, which are symmetrical relative to a center of the tray, each of said edge extensions being connected on one side to a tongue for securing on an adjacent lateral wall opposite, and having an end part forming a surface which is deformed towards an exterior of the top of said tray, thus constituting one of said bulged portions due to an effect of cambering of said end part.

4. The tray as claimed in claim 3, comprising two sets of two corner edge extensions which are symmetrical relative to a transverse axis of the tray.

5. The tray as claimed in claim 3, wherein the end part is in the form of a rounded ear which is folded towards an interior of the tray.

6. The tray as claimed in claim 1, wherein each edge extension is formed by a flap with a projecting part which constitutes said bulged portion, and comprises an end part connected to a tongue for securing on an adjacent lateral wall.

7. The tray as claimed in claim 1, wherein the joining lines are in the form of a compressed Ω, the top of which faces towards the exterior of the tray.

8. The tray as claimed in claim 1, wherein at least two lateral ends of projecting bulged portions which are situated respectively towards the lateral walls adjacent to the wall of the edge extensions on the same side of the tray, are extended by a line which can be cut in the adjacent wall opposite aslant towards the line for joining with the base, as far as the outer end of the portions of perforated surface.

9. A blank made of corrugated sheet cardboard material, configured to form a tray with a polygonal cross-section comprising lateral surfaces, edge extensions on two opposite sides at upper outer edges, and a base of the tray, wherein each edge extension is foldable along a corresponding continuous joining line to form only one bulged portion which projects relative to surrounding regions of a top surface of the tray when said tray is being formed, and the base comprises portions of perforated surface with a form complementary to said rounded portions, and each edge extension is formed by a flap which is integral with a top of an adjacent one of the lateral surfaces via its corresponding joining line which, in a portion of the joining line limited to a region between the edge extension and the top of that adjacent one of the lateral surfaces, is either (i) not straight or (ii) has a first part not aligned continuously with a second part.

10. The blank as claimed in claim 9, comprising a lower surface which forms the base, and at least two corner portions which are symmetrical relative to a center of the blank, said portions being connected on one side to securing tongues, and having on the other side an end part which can form a surface which is deformed towards the exterior of said tray, in order to constitute the bulged parts when the tray is being formed.

11. The blank as claimed in claim 10, comprising two sets of two corner portions which are symmetrical relative to a transverse axis of the blank.

12. The blank as claimed in claim 9, comprising lower flaps which are situated on one side of the lateral surfaces, in order to form the base of the tray, and at least two corner portions of raised edges which are situated on the other side of the walls, said portions having an end part which can form a surface which is deformed towards the exterior of said tray, in order to constitute the bulged portions when the tray is being formed.

13. The blank as claimed in claim 10, wherein the end parts are in the form of a rounded ear.

14. The blank as claimed in claim 9, wherein each edge extension comprises a flap with a central part which can project in order to constitute one of said bulged portions when the tray is being formed, and two end parts connected to tongues for securing on the adjacent lateral wall opposite.

15. The blank as claimed in claim 9, wherein the joining lines are in the form of a compressed Ω, the top of which faces towards the exterior of the blank.

16. The blank as claimed in claim 9, wherein at least two lateral ends of projecting bulged portions are respectively extended by a line which can be cut in the wall of the raised edge, said line which can be cut opposite aslant towards the line for joining with the base, as far as the outer end of the portions of perforated surface.

* * * * *